US007082821B2

(12) United States Patent
Chen et al.

(10) Patent No.: US 7,082,821 B2
(45) Date of Patent: Aug. 1, 2006

(54) METHOD AND APPARATUS FOR DETECTING TORSIONAL VIBRATION WITH A DOWNHOLE PRESSURE SENSOR

(75) Inventors: Chen-Kang David Chen, Houston, TX (US); Paul D. Beene, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/413,837

(22) Filed: Apr. 15, 2003

(65) Prior Publication Data

US 2004/0206170 A1 Oct. 21, 2004

(51) Int. Cl.
*E12B 44/04* (2006.01)
*G01H 1/10* (2006.01)

(52) U.S. Cl. ..... 73/152.47; 73/152.43; 73/152.46; 73/649; 73/650; 175/40; 175/48; 175/50

(58) Field of Classification Search ..... 73/65.07, 73/65.08, 152.43, 152.46–152.49, 649, 650; 175/40, 48, 50
See application file for complete search history.

(56) References Cited

U.S. PATENT DOCUMENTS 2,887,298 A * 5/1959 Hampton ..... 33/307
3,703,096 A * 11/1972 Vitter et al. ..... 73/152.47
4,078,620 A * 3/1978 Westlake et al. ..... 175/48
4,359,898 A 11/1982 Tanguy et al. ..... 73/151
4,550,392 A * 10/1985 Mumby ..... 367/82
4,878,206 A * 10/1989 Grosso et al. ..... 367/83
4,903,245 A * 2/1990 Close et al. ..... 340/853.3
5,055,837 A * 10/1991 Abdallah et al. ..... 367/83
5,117,926 A * 6/1992 Worrall et al. ..... 175/56
5,146,433 A * 9/1992 Kosmala et al. ..... 367/83
5,205,163 A * 4/1993 Sananikone ..... 73/152.48
5,226,332 A * 7/1993 Wassell ..... 73/152.58
5,272,680 A * 12/1993 Stone et al. ..... 367/85
5,289,354 A * 2/1994 Clayer et al. ..... 367/82
5,321,981 A 6/1994 Macpherson ..... 73/151
5,331,318 A * 7/1994 Montgomery ..... 340/855.4
5,721,376 A 2/1998 Pavone et al. ..... 73/152.47
5,842,149 A * 11/1998 Harrell et al. ..... 702/9
5,864,058 A * 1/1999 Chen ..... 73/152.47
6,021,377 A * 2/2000 Dubinsky et al. ..... 702/9
6,023,658 A * 2/2000 Jeffryes ..... 702/16
6,065,332 A 5/2000 Dominick ..... 73/152.58

(Continued)

OTHER PUBLICATIONS

"Pore and Fracture Pressure Information from PWD Data," Chris Ward & Mitch Beique, 2002 AADE Drilling Technology Forum, Best Available Practical Drilling Technology—The Search Continues; Feb. 9-10, 2000.

(Continued)

*Primary Examiner*—Hezron Williams
*Assistant Examiner*—David A. Rogers
(74) *Attorney, Agent, or Firm*—Conley Rose, P.C.

(57) ABSTRACT

A method and apparatus for detecting torsional vibration, or stick-slip, in a drill string while drilling is described. The method comprises sampling a downhole pressure sensor and using embedded filter schemes and algorithms to determine, based on the pressure samples, whether torsional vibration is occurring in the drill string. The method may also include sending a warning signal to the surface of the well. The apparatus comprises a downhole assembly having a downhole receiver and a master controller. The downhole receiver comprises a pressure sensor, filter schemes, and algorithms for detecting torsional vibration. The downhole assembly may also include a downhole transmitter for sending a warning signal to the surface of the well.

20 Claims, 9 Drawing Sheets

U.S. PATENT DOCUMENTS

| | | | | |
|---|---|---|---|---|
| 6,097,310 | A | 8/2000 | Harrell et al. | 340/854.3 |
| 6,182,764 | B1 * | 2/2001 | Vaynshteyn | 166/373 |
| 6,227,044 | B1 | 5/2001 | Jarvis | 175/40 |
| 6,370,082 | B1 | 4/2002 | Gardner et al. | 367/82 |
| 6,536,529 | B1 * | 3/2003 | Kerr et al. | 166/375 |
| 6,564,883 | B1 * | 5/2003 | Fredericks et al. | 175/50 |
| 2002/0180613 | A1 * | 12/2002 | Shi et al. | 340/853.1 |
| 2003/0016164 | A1 | 1/2003 | Finke et al. | 342/83 |

OTHER PUBLICATIONS

SPE 26341; "Development and Field Testing of a New Downhole MWD Drillstring Dynamics Sensor," S.A. Zannoni, et al., pp. 269-283.

SPE/IADC 37588; "Pressure While Drilling Data Improves Reservoir Drilling Performance," C. D. Ward; pp. 159-168.

* cited by examiner

METHOD AND APPARATUS FOR DETECTING TORSIONAL VIBRATION WITH A DOWNHOLE PRESSURE SENSOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to communicating between control equipment on the earth's surface and a subsurface drilling assembly to command downhole instrumentation functions. In particular, the present invention relates to communicating, detecting, and decoding instructions to the drilling assembly via pressure pulse signals sent from a surface transmitter without interrupting drilling. More particularly, the present invention relates to apparatus and methods for using the pressure pulse signals to detect torsional vibrations, or stick-slip, in the drill string while drilling.

2. Background and Related Art

In hydrocarbon drilling operations, the drill bit and other components of the bottom hole assembly (BHA), and even the drill string itself, are subjected to conditions which increase wear and degradation of these expensive components. One such condition is called "stick-slip," or torsional vibration of the BHA. Stick-slip is a downhole condition where torsional vibrations have increased because the bit and BHA are experiencing increased friction and drag at the bit, causing the bit to stop rotating. Once the bit has stopped rotating, torque tends to build up in the drillstring. The torque buildup causes the energy in the drillstring to increase until it overcomes the drag friction between the bit/BHA and the earthen formation, which frees the bit momentarily until the drag friction overcomes the rotational energy in the drillstring again. This causes a periodic motion called stick-slip.

Stick-slip is a major contributing factor to excessive bit wear. Torsional vibration can have the effect that cutters on the drill bit may momentarily stop or be rotating backwards, i.e., in the reverse rotational direction to the normal forward direction of rotation of the drill bit during drilling. This is followed by a period of forward rotation of many times the rotation per minute (RPM) mean value. The effect of reverse rotation on a cutter element may be to impose unusual loads on the cutter which tend to cause spalling or delamination of the polycrystalline diamond facing of the tungsten carbide cutter.

If it is known that stick-slip is occurring in the BHA, it may be possible for the operator of the rotary drilling system, at the surface, to reduce or stop the vibration by modifying the drilling parameters, for example by changing the speed of rotation of the drill string (RPM) and/or the weight-on-bit (WOB). However, it is currently difficult to detect at the surface torsional vibration which is occurring in the BHA, and several techniques have been developed to address the problem of detecting the onset of stick-slip of the BHA.

One such method includes the use of downhole RPM data to detect stick-slip. Typically, the average surface and downhole RPM of the drilling assembly is 60 to 150 RPM's. In the event of excessive rotational vibrations, or stick-slip, the downhole RPM's can reach 3 to 5 times, or higher, the average surface RPM's. Downhole RPM data is a direct measurement to detect stick-slip. Devices or tools may be placed downhole to measure RPM, the most common of which is the magnetometer. Using the earth's magnetic field as a reference, the magnetometer can measure how fast the BHA is rotating, and then it is possible to calculate the RPM.

Another prior art method for detecting stick-slip is the use of surface torque data. The surface torque data, when charted as a function of time, will exhibit a periodic motion. The period of the surface torsional vibration will be the same as the period for the downhole torsional vibration, and thus the period may be used to detect stick-slip. Such a method is described in U.S. Pat. No. 6,227,044 to Jarvis, hereby incorporated herein by reference for all purposes.

Additional devices for detecting destructive downhole vibrations include Sperry-Sun's DDS™ Drillstring Dynamics Sensor and Drilsaver™ Real-Time Torsional Vibration Monitor.

However, these prior art methods have associated problems. One problem is the need for additional sensors, such as rotational sensors or magnetometers, or mechanical devices with moving parts. Thus, it would be desirable to use equipment already present in the drilling assembly to detect stick-slip, as well as inherent phenomena associated with the drilling process.

Sometimes, the drilling assembly may include a system for communicating between the surface equipment and the subsurface drilling assembly. Downlink signaling, or communicating from the surface equipment to the drilling assembly, is typically performed to provide instructions in the form of commands to the drilling assembly. For example, in a directional drilling operation, downlink signals may instruct the drilling apparatus to alter the direction of the drill bit by a particular angle or to change the direction of the tool face. Uplink signaling, or communicating between the drilling assembly and the surface equipment, is typically performed to verify the downlink instructions and to communicate data measured downhole during drilling to provide valuable information to the drilling operator.

A common method of downlink signaling is through mud pulse telemetry. When drilling a well, fluid is pumped downhole such that a downhole receiver within the drilling assembly can meter the pressure. Mud pulse telemetry is a method of sending signals by creating a series of momentary pressure changes, or pulses, in the drilling fluid, which can be detected by a receiver. For downlink signaling, the pattern of pressure pulses, including the pulse duration, amplitude, and time between pulses, is detected by the downhole receiver and then interpreted as a particular instruction to the downhole assembly.

For a more detailed description of mud pulse telemetry, and an improved downlink telemetry system, see U.S. Patent Application Publication No. 2003/0016164 Al to Finke et al., application Ser. No. 09/783,158, which was filed on Feb. 14, 2001 and published on Jan. 23, 2003 (the "'158 application"), hereby incorporated herein by reference for all purposes. The '158 application discloses a downlink telemetry system that can be used without interrupting drilling and without interrupting uplink communication such that simultaneous, bi-directional communication is achievable if the uplink and downlink signals are sent at different frequencies. Moreover, the '158 application discloses an algorithm for filtering and decoding the downlink signals. The algorithm determines the time intervals between pulse peaks and decodes the intervals into an instruction.

The stick-slip motion previously described causes pressure fluctuations or pulses downhole. As described above and in the '158 application, the mud pulse telemetry system of the drilling assembly uses mud pulses to communicate. The stick-slip pressure pulses and the telemetry pulses may have very similar frequencies, therefore the noise created by the stick-slip pressure pulses may interfere with proper telemetry signaling.

An objective of the present invention is to use the already present mud pulse telemetry system and its associated pressure while drilling (PWD) sensor to detect the pressure fluctuations created by stick-slip.

Another objective of the invention is to act upon the detection of stick-slip to adjust certain drilling parameters and thereby improve the drilling operation.

Yet another objective of the invention is to improve the reliability of the downlink system by detecting the "false" downlink pulses induced by stick-slip. An aspect of this objective is to filter out such false downlink pressure pulses created by stick-slip.

The present invention overcomes the deficiencies of the prior art.

SUMMARY OF THE PREFERRED EMBODIMENTS

The present invention provides improved methods and apparatus for detecting torsional vibration in a drillstring while drilling via pressure pulses from the drillstring that are sampled by a downhole pressure sensor.

The method of detecting torsional vibration in a drillstring while conducting a drilling operation in a subterranean well comprises sampling a downhole pressure sensor to obtain a data set and further determining whether the data set indicates torsional vibration in the drillstring.

In another embodiment, a method of detecting torsional vibration in a drillstring while conducting a drilling operation in a subterranean well, the drillstring being part of a drilling assembly having a mud pulse telemetry system capable of sending uplink or downlink signals, comprises sampling a downhole pressure sensor to obtain a first data set; analyzing the first data set; and further determining whether the data set indicates torsional vibration in the drillstring. This embodiment further comprises applying filter schemes, cross-correlation algorithms, and peak-detect algorithms to analyze the data and determine if torsional vibration has occurred. Furthermore, this embodiment comprises applying a threshold value to the data set, determining if a significant number of peak values exceed the threshold value for a predetermined amount of time, and sending a warning signal to the surface of the well as necessary.

In yet another embodiment, a method of filtering noise caused by torsional vibration in a drillstring while drilling in a subterranean well, the drillstring being part of a drilling assembly having a mud pulse telemetry system capable of sending uplink or downlink signals, comprises detecting torsional vibration in the drillstring and changing the downlink signal frequency such that the torsional vibration frequency does not interfere with the downlink signal frequency.

The drilling assembly for detecting torsional vibration in a drillstring located in a subterranean well comprises a pressure sensor for sampling the pressure in a flow of fluid being pumped downhole; a control system for sampling the pressure sensor without stopping the fluid pumping; and a scheme for detecting pressure samples caused by torsional vibration in the drillstring.

Thus, the present invention comprises a combination of features and advantages which enable it to overcome various problems of prior art torsional vibration detection systems. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a detailed description of a preferred embodiment of the invention, reference will now be made to the accompanying drawings wherein.

NOTATION AND NOMENCLATURE

In the following discussion and in the claims, the terms "including" and "comprising" are used in an open-ended fashion, and thus are to be interpreted to mean "including, but not limited to . . . ". Reference to up or down will be made for purposes of description with "up," "upward," or "upper" meaning toward the surface of a well and "down," "downward," or "lower" meaning toward the bottom of a well.

This exemplary disclosure is provided with the understanding that it is to be considered an exemplification of the principles of the invention, and is not intended to limit the invention to that illustrated and described herein. In particular, various embodiments of the present invention provide a number of different constructions and methods of operation. It is to be fully recognized that the different teachings of the embodiments discussed below may be employed separately or in any suitable combination to produce desired results.

DETAILED DESCRIPTION OF THE PREFERRED EMBODIMENTS

Figure 1:
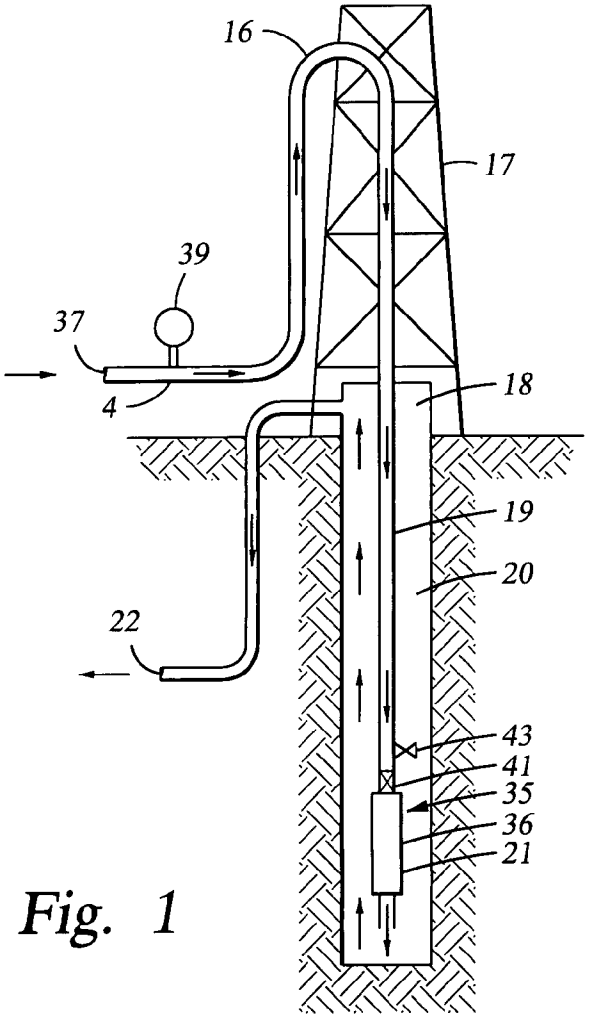
FIG. 1 is a schematic showing a portion of a typical drilling operation that may employ a downlink telemetry system and the formation testing equipment and pressure sensor of the present invention.

A number of embodiments of methods and apparatus for detecting torsional vibrations, or stick-slip, in a drillstring according to the present invention will now be described with reference to the accompanying drawings. Referring initially to FIG. 1, there is depicted a typical drilling operation where mud pulse telemetry may be used. A well bore 20, which may be open or cased, is disposed below a drilling rig 17. A drill string 19 with a drilling assembly 35 connected to the bottom, is disposed within the well 20, forming an annular flow area 18 between the drill string 19 and the well 20. On the surface, a mud pump (not shown) draws drilling fluid from the fluid reservoir (not shown) and pumps the fluid into the pump discharge line 37, along path 4. The circulating fluid flows, as shown by the arrows, into the drilling rig standpipe 16, through the drill string 19, and returns to the surface through the annulus 18. After reaching the surface, the circulating fluid is returned to the fluid reservoir via the pump return line 22.

In general, to generate either uplink or downlink signals via mud pulse telemetry, a series of pressure changes, called pulses, are sent in a set pattern to either an uplink receiver 39 on the surface or a downlink receiver 21 in the downhole assembly 35. The amplitude and frequency of the pressure changes are analyzed by the receivers 39, 21 to decode the information or commands being sent. To illustrate, one uplink signal can be sent by momentarily restricting fluid downhole, at a valve 41 for example, as the fluid is pumped down the drill string 19. The momentary restriction causes a pressure increase, or a positive pulse, when the fluid impacts the point of restriction. The positive pulse travels back up the fluid in the drill string 19, and an uplink receiver 39 at the surface, typically a pressure transducer, reads the increase in pressure. An uplink signal can also be sent as a negative pulse by opening a valve 43 between the drill string 19 and the annulus 18 to allow fluid to escape, thereby creating a negative pressure wave that travels to the surface receiver 39. Using this method, the downhole assembly 35 communicates with the surface receiver 39 using either a positive pulser 41 or a negative pulser 43 that creates a series of pressure pulses that travel to the surface receiver 39.

Additional details regarding the structure and operations of the surface transmitter assembly, surface transmitter control system, downhole receiver assembly, and other components of the mud pulse telemetry system are found in the '158 application, which are hereby incorporated herein by reference. It should be noted that the preferred mud pulse telemetry system for the present invention is embodied in the description provided by the '158 application.

Figure 2:
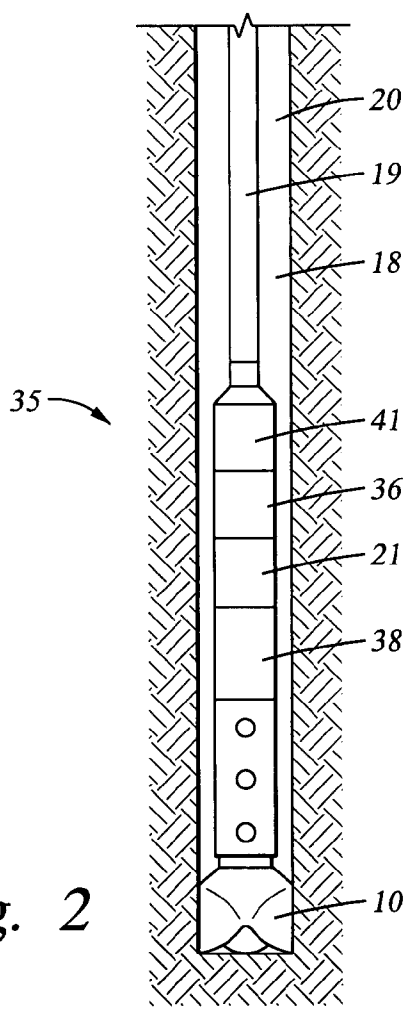
FIG. 2 is an alternative embodiment of the bottom hole assembly including a pressure sensor.

Referring now to FIG. 2, an alternative embodiment of the BHA is shown including a pulser 41, a master controller 36, the downhole receiver 21, the drill bit 10, and any additional downhole equipment 38 which may be needed. Such additional equipment may include Sperry-Sun's Geo-Pilot® Rotary Steerable System and Geo-Span™ downlink system. Downhole receiver 21 includes a pressure sensor, such as a pressure transducer. The preferred design utilizes a standard pressure while drilling (PWD) tool, such as Sperry-Sun's PWD® tool, with modified software. PWD sensor 21 works in conjunction with a master controller 36 disposed in the downhole assembly 35. The telemetry scheme and algorithm for decoding the downlink signals are programmed primarily into the downhole receiver 21. The master controller 36 completes the signal decoding and distributes the downlink instructions to the appropriate tool within the downhole assembly 35. Further details regarding the telemetry scheme and algorithm for decoding the downlink signals are found in the '158 application, and are hereby incorporated herein by reference.

Figure 3A:
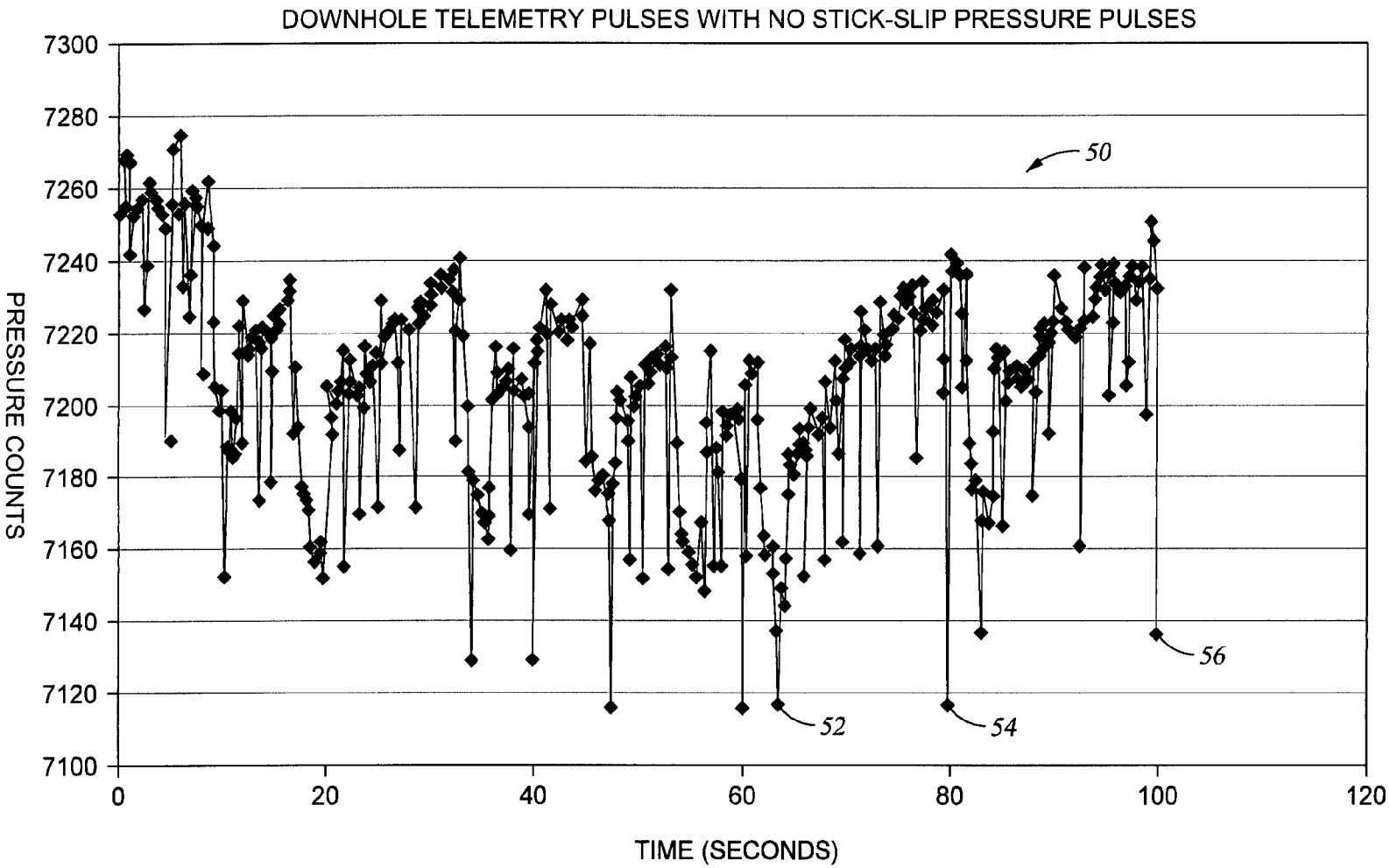
FIG. 3A provides a graph of the raw sample data output from samplings of the pressure sensor during the use of only uplink and downlink telemetry pulses.

Referring now to FIGS. 3A–D, raw and filtered pressure data is shown which corresponds to a downhole environment containing only telemetry pulses. In other words, the drilling assembly is not experiencing a stick-slip condition, so the only pressure fluctuations are being produced by the uplink and downlink signals of the telemetry system. In FIG. 3A, raw pressure data 50 represents the pressure pulses sensed by PWD sensor 21 in response to the telemetry signals. The data 50 is gathered by sampling the downhole PWD sensor pressure at a certain frequency. Preferably, the pressure data is sampled at a frequency of at least 1 Hertz (Hz). Also, the bore or annulus pressure may be sampled, although the bore pressure is preferred. As an alternative embodiment, the annulus pressure may be sampled. Again, raw data 50 does not include data representing drilling and pumping noise, or rotational vibration pressure fluctuations.

FIG. 3A shows the raw data 50 that has been gathered downhole and transmitted to the surface via the uplink signal. The data 50 is plotted on a time vs. pressure counts graph, where time is in seconds on the x-axis and pressure counts make up the dependent y-axis. The pressure pulses created by the telemetry system contain both uplink and downlink signals. The smaller negative spikes, such as spikes 52, 54, 56, represent the uplink signals. The remaining data represent the downlink signals.

Figure 3B:
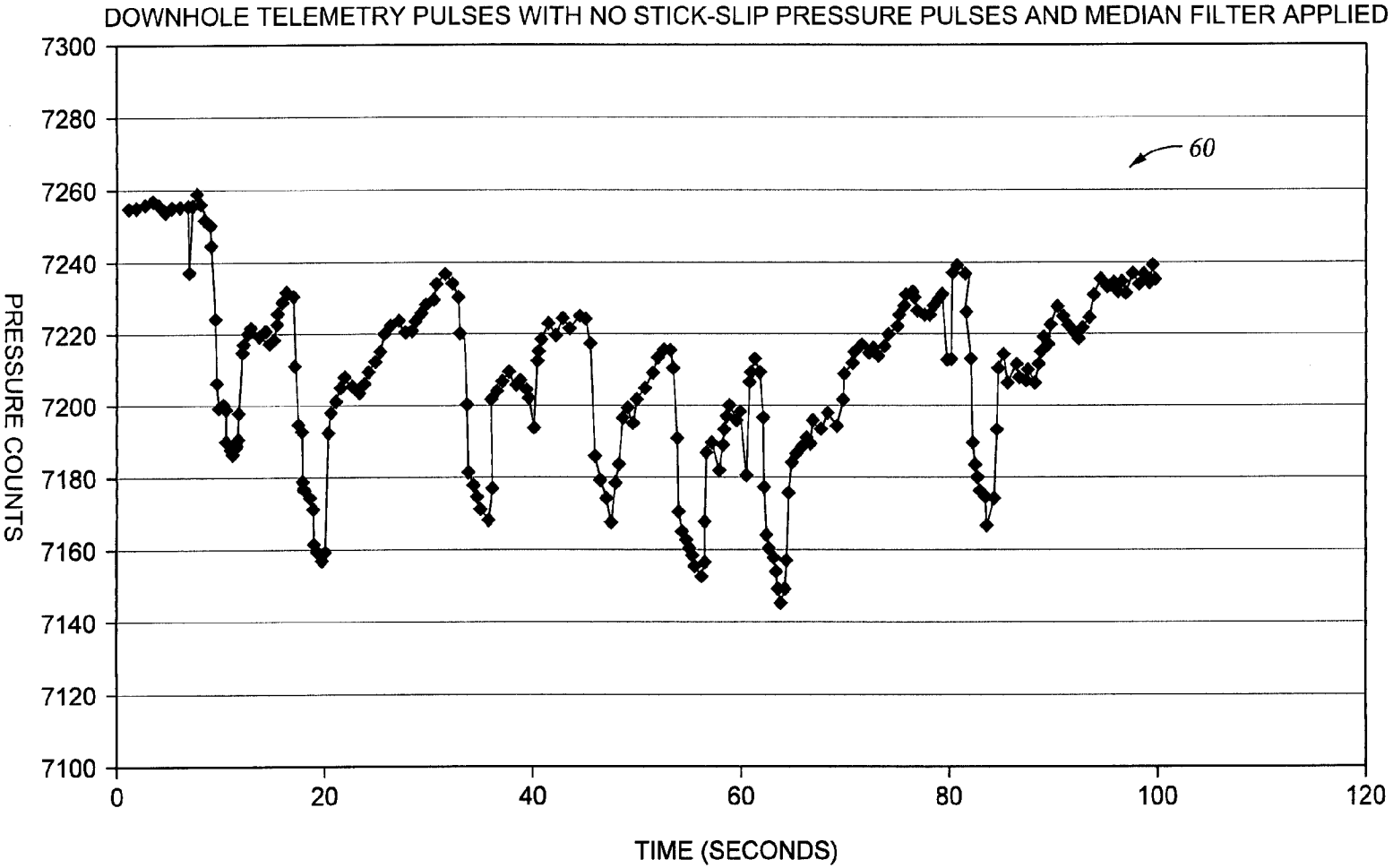
FIG. 3B provides a graph of the sample data output given in response to the application of a median filter to the raw sample data of FIG. 3A.

To separate the uplink telemetry signals from the downlink signals, a median filter is applied. Median filters and their application are well known to those skilled in the art, and a more detailed description of the median filter and its application can be found in the '158 application, which is hereby incorporated herein by reference. Referring now to FIG. 3B, data set 60 is shown where the uplink signals have been eliminated and the downlink signals are represented as pressure counts as a function of time in seconds.

Figure 3C:
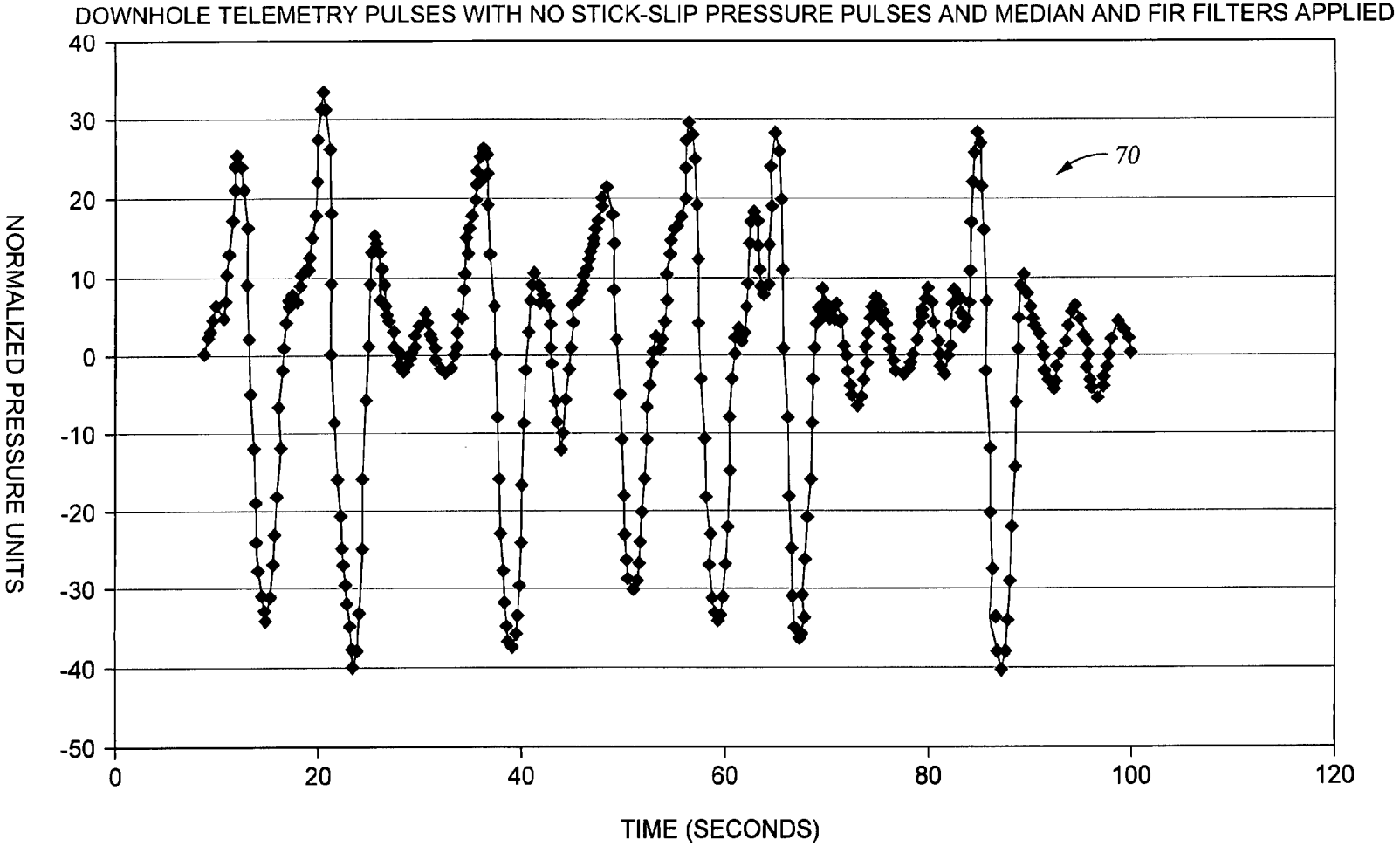
FIG. 3C provides a graph of the sample data output given in response to the application of an FIR filter to the sample data of FIG. 3B.

Next, a digital-type filter, such as a Finite Impulse Response (FIR) filter, is applied to the pressure data output from the median filter. The FIR filter is also described in detail in the '158 application, such description being hereby incorporated herein by reference. Referring now to FIG. 3C, data set 70 shows the output sample set remaining after the FIR filter has been applied. The data 70 is graphed in pressure counts as a function of time in seconds. What remains is downlink signal data corresponding to a particular frequency. The pulses are approximately two seconds in duration.

Figure 3D:
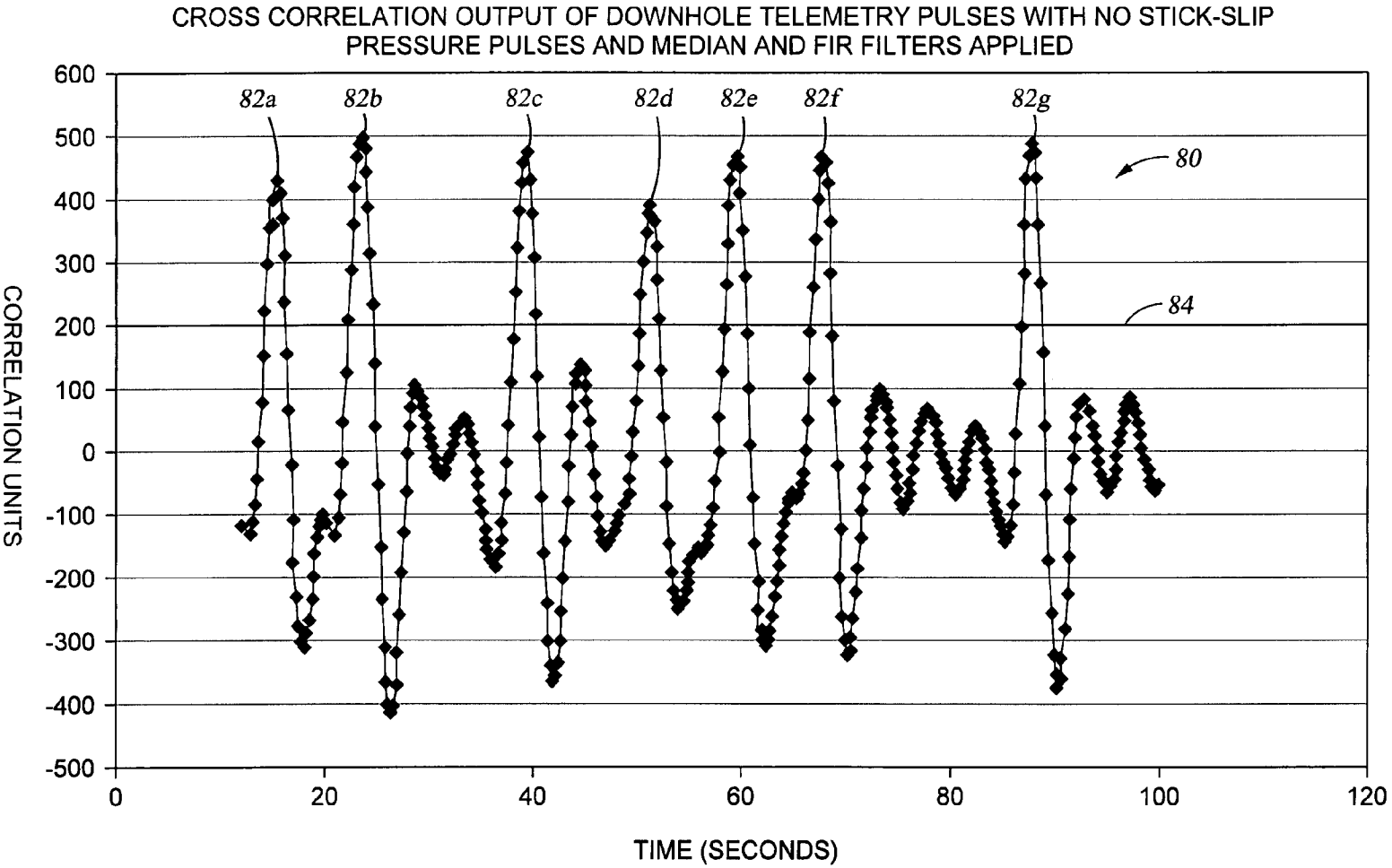
FIG. 3D provides a graph of the sample data output given in response to the application of a cross-correlation algorithm to the sample data of FIG. 3C.

A cross-correlation algorithm is applied to the output data of the FIR filter, such a cross-correlation algorithm being described in the '158 application and hereby incorporated herein by reference. Referring to FIG. 3D, data set 80 represents the cross correlation output, where the cross correlation output points are arbitrary cross correlation units as a function of time in seconds. Once the cross correlation data has been plotted, a threshold correlation unit value 84 is determined and a peak-detect algorithm is used to apply the value 84 to data 80. Threshold value 84 can be any value the user deems appropriate. Threshold value 84 is a download parameter that is set at the surface. Once threshold value 84 has been determined and applied to data 80, the peak-detect algorithm defines pulses by marking all signals whose amplitudes exceed the threshold value.

For example, if threshold value 84 is set at 200, as shown in FIG. 3D, and is applied to data 80, the signals 82*a–g* are determined to be pulses because their amplitudes exceed 200. The peak-detect algorithm marks these signals as pulses as each one occurs, and then determines the difference in time (Δt) between each consecutive pulse. The goal is to define all of the time intervals between each pulse in data set 80, thereby making Δt available for encoding and decoding the pulse data. Decoding signals into instructions and the use of pulse position modulation (PPM) to code signals is described in further detail in the '158 application. PPM is preferable when using Δt of the pulse signals, although other signal process methods may be used to detect the pulses.

As mentioned above, the present invention includes a downhole receiver having a pressure sensor. Preferably, the pressure sensor is a standard pressure while drilling (PWD) tool, such as Sperry Sun's PWD® tool, with modified software. The filters and algorithms just described are embedded in the modified software of the PWD tool. Even if the software of the PWD tool is not modified, it is preferred that the filters and algorithms of the present invention be embedded in the PWD tool. Alternatively, the filters and algorithms may be embedded in other portions of the BHA having embedded software.

Figure 4A:
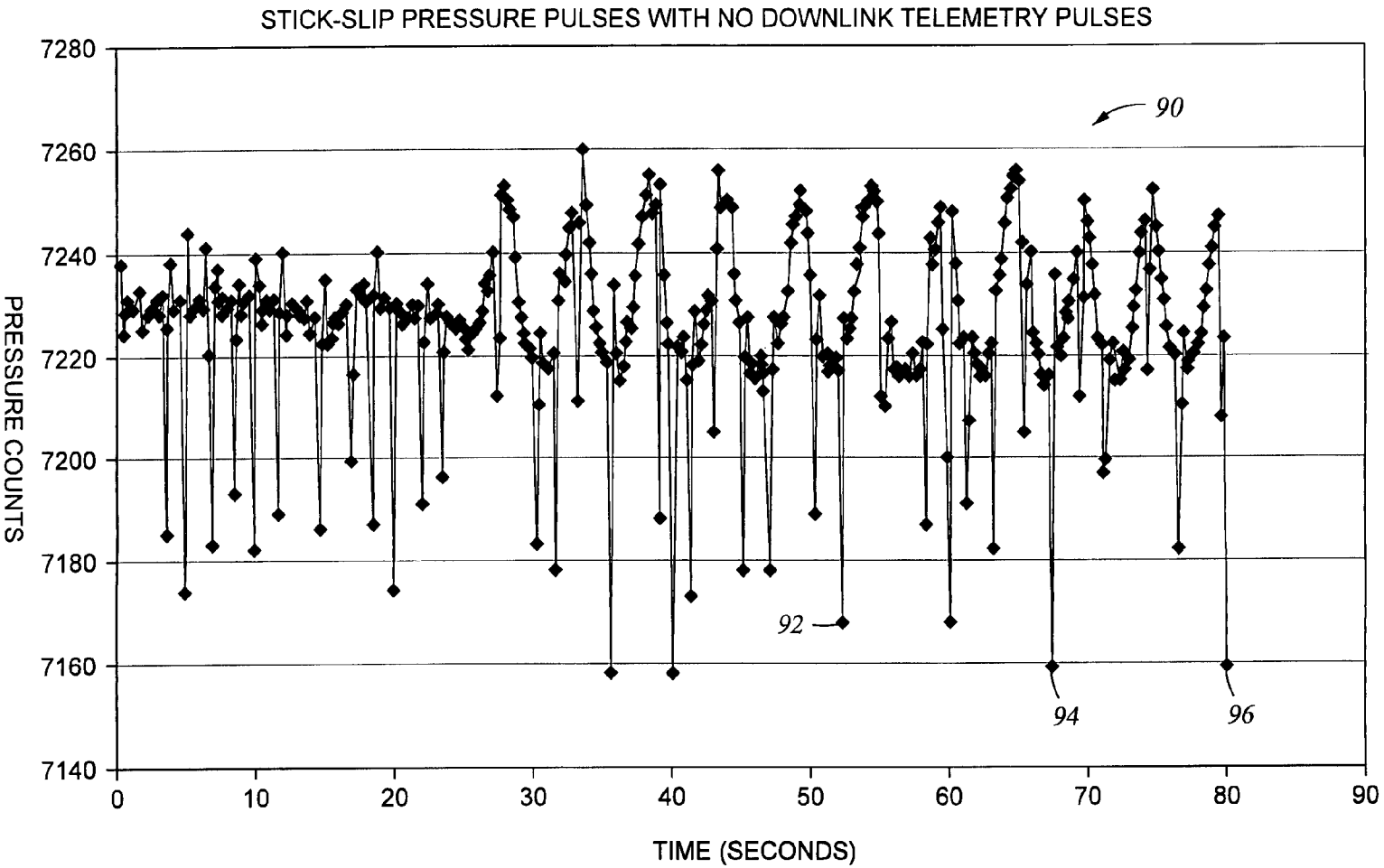
FIG. 4A provides a graph of the raw sample data output from samplings of the pressure sensor during a stick-slip condition and without the use of downlink telemetry pulses.

Referring now to FIG. 4A, another sampling of the PWD pressure sensor 21 has been graphed. However, in this case, the raw data 90 reflects data taken in an environment where no downlink telemetry is present. Raw data 90 corresponds to the pressure fluctuations sensed by the pressure sensor 21 during stick-slip. As a result, data set 90 looks similar to data set 50 in FIG. 3A.

Figure 4B:
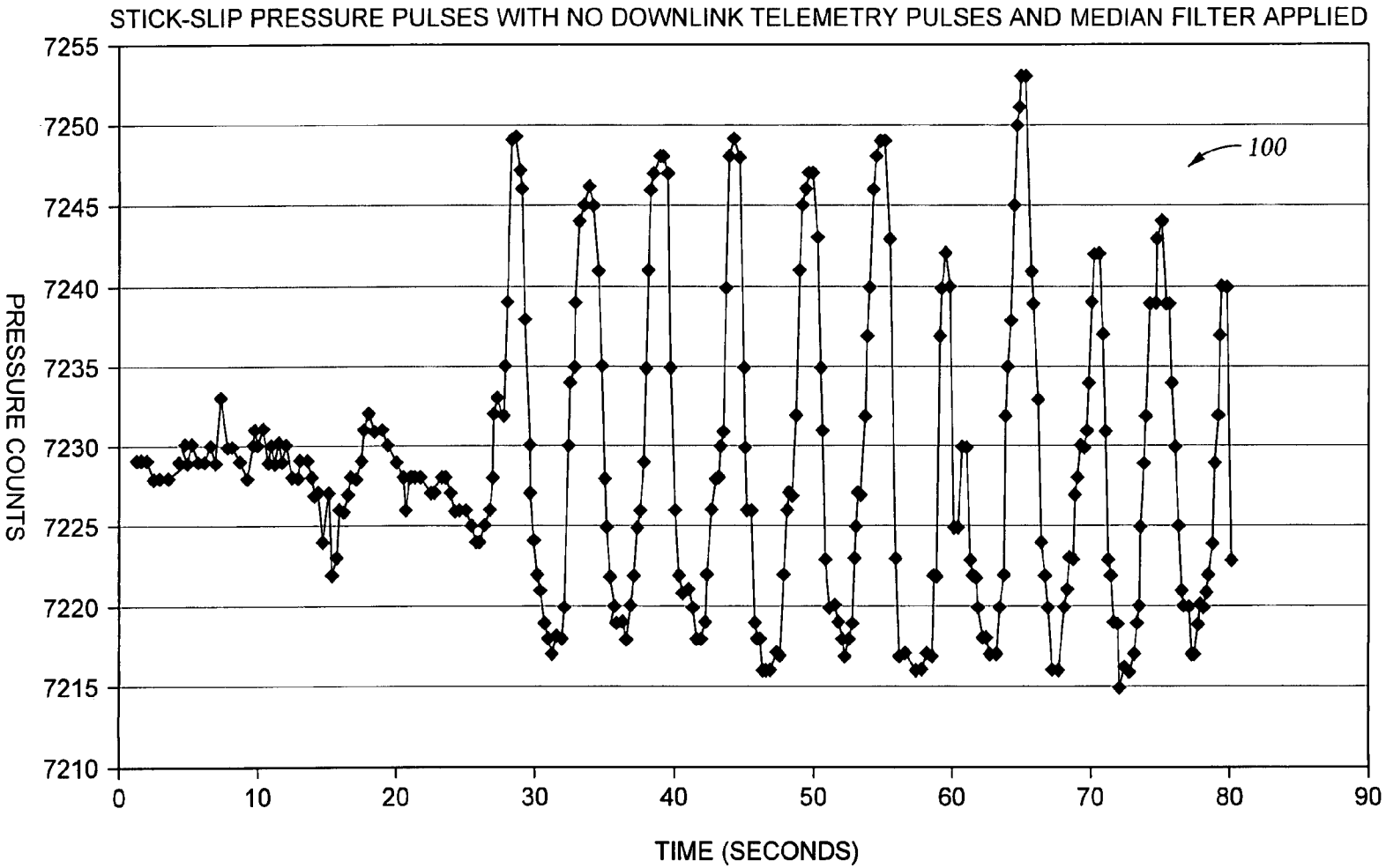
FIG. 4B provides a graph of the sample data output given in response to the application of a median filter to the raw sample data of FIG. 4A.
Figure 4C:
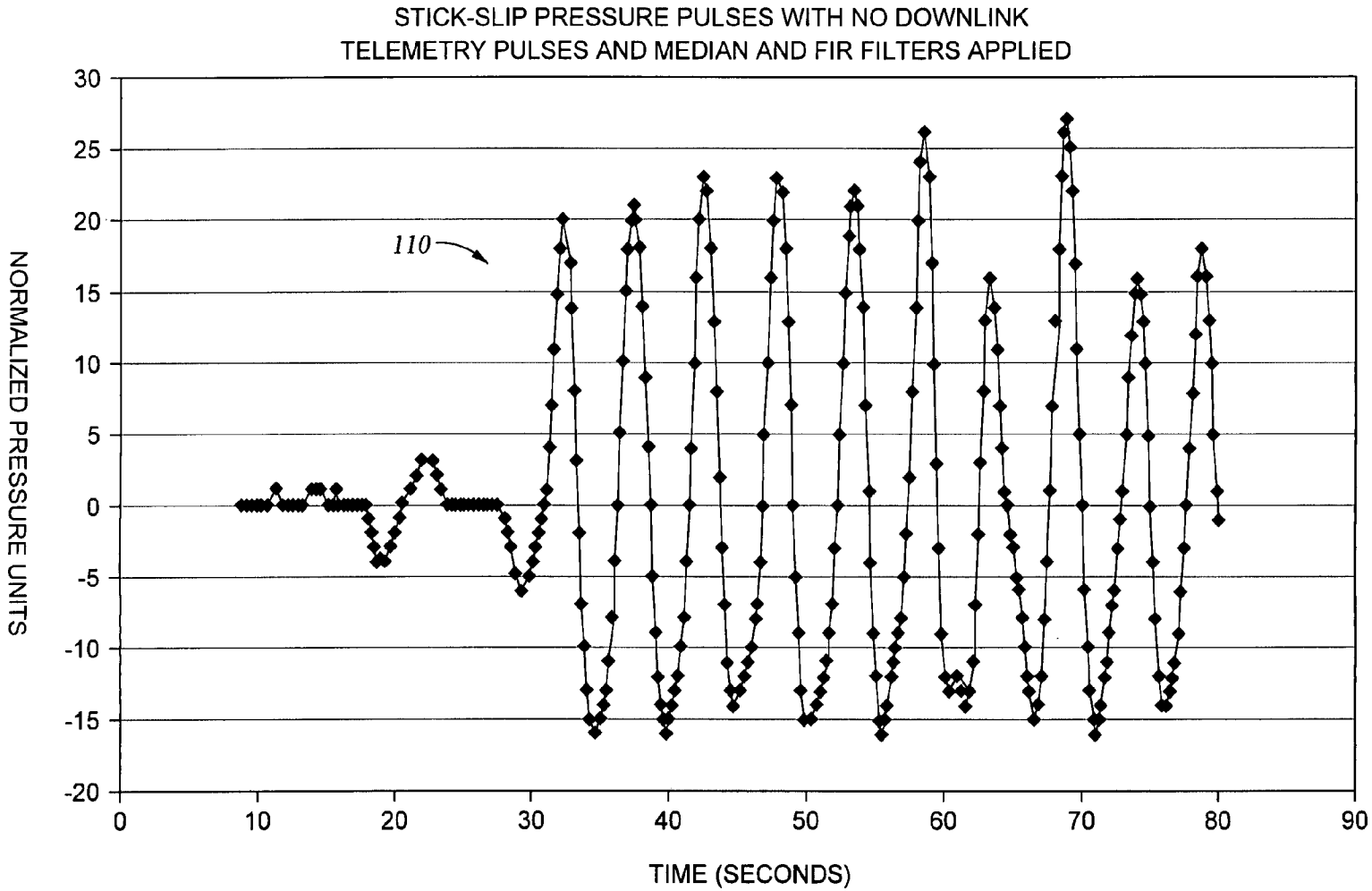
FIG. 4C provides a graph of the sample data output given in response to the application of an FIR filter to the sample data of FIG. 4B.

The same process described above of employing the median and FIR filters, and the cross-correlation and peak-detect algorithms may be used to detect the stick-slip condition. FIG. 4B provides the data set 100 after a median filter has been applied to raw sample data 90. Sample set 100 is then subjected to an FIR filter which provides the sample data set 110 of FIG. 4C. Subsequently, a cross-correlation algorithm is applied to sample data set 110 to provide the output data set 120 of FIG. 4D.

Figure 4D:
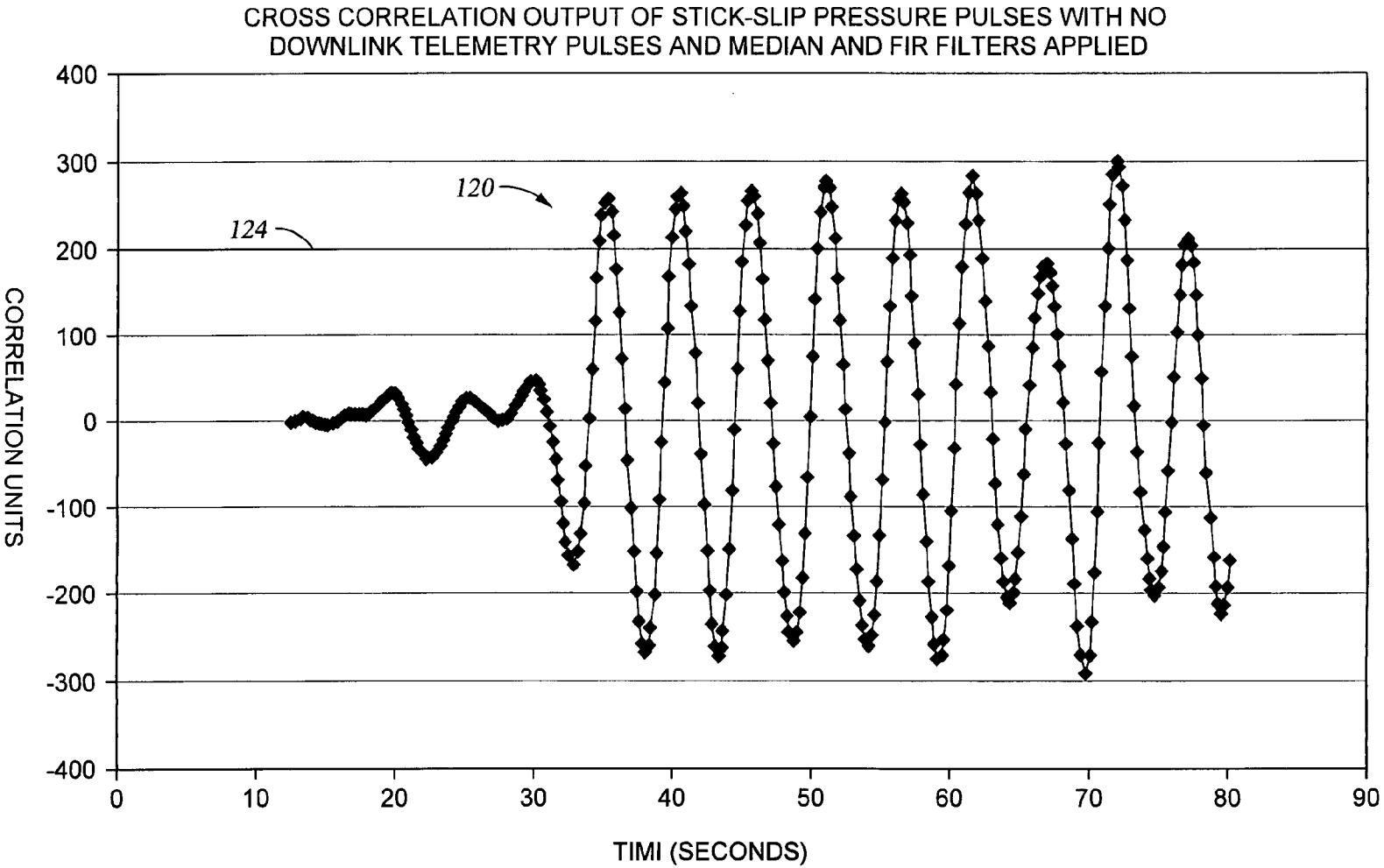
FIG. 4D provides a graph of the sample data output given in response to the application of a cross-correlation algorithm to the sample data of FIG. 4C.

Data set 120 can then be analyzed using a peak-detect algorithm and the threshold value 124, as previously described. FIG. 4D shows value 124 to be approximately 200, though it can be changed according to the operator's desires. If the peak amplitudes of the data are greater than threshold value 124 for a predetermined period of time, or, more precisely, number of cycles, then a stick-slip condition has been detected. For example, if a significant number of the peak amplitudes of data set 120 exceed the threshold value 124 for a range of approximately five to ten cycles, at whatever period and frequency the stick-slip pressure pulses occur, then stick-slip has been detected. It should be noted that the time period or number of cycles used to determine stick-slip may vary according the operator's desires, but it is preferred that this value be pre-determined and pre-set. It should also be noted that the significant number of peak values exceeding the threshold value needed to determine stick-slip depends on numerous factors associated with the particular drilling operation, and will thus be determined on a case-by-case basis. When stick-slip is detected, a warning is sent to the surface of the well via the uplink telemetry system.

Once the warning has been sent to the surface and decoded, the operator can change the drilling parameters to eliminate stick-slip. The operator may change the RPM of the drillstring or the weight-on-bit. However, problems may still persist, depending on the circumstances, with simply detecting stick-slip and adjusting drilling parameters.

First, as can be seen by a comparison of graphs 3A–D and graphs 4A–D, the stick-slip pressure fluctuations can be very similar to the downlink telemetry pressure pulses. The downlink signals and the stick-slip pressure fluctuations also have very similar frequencies. Although these frequencies can vary according to certain parameters, such as formation type, drilling fluid type, and depth of the well, a typical frequency range, for example, may be approximately 0.1 to 1 Hz. Consequently, the stick-slip pressure fluctuations tend to serve as false downlink signals which are mistakenly picked up by the downlink mud pulse telemetry system. Moreover, if downlink telemetry pulses are being used during stick-slip, the stick-slip pressure fluctuations can interfere with concurrent telemetry signals to produce inaccurate communication between the surface and the downhole receiver. Thus, in one embodiment of the present invention, once stick-slip is detected, it may be desirable to change the downlink frequency such that the stick-slip pressure fluctuations no longer interfere with the downlink signals. It should be appreciated that changing the downlink signal frequency may be used regardless of the method used to detect stick-slip.

The process of changing the downlink signal frequency may vary depending on the circumstances and the mud pulse telemetry system used. It may require changes to the surface software code, as well as the embedded downhole code. Details regarding changes to the downlink signal frequency may be gleaned from the '158 application disclosure.

In yet another embodiment of the invention, the pressure pulses or fluctuations attributed to stick-slip may be filtered out entirely. This method is especially useful when a stick-slip condition has been encountered during drilling at a time when telemetry pulses are also being used. In this situation, downlink signals are traveling down the well, uplink signals are traveling up the well, and stick-slip pressure signals are creating noise throughout the well, thereby contaminating the useful and desirable telemetry signals.

Generally, the method of this embodiment includes the steps described with reference to FIGS. 3A–D and 4A–D. As described previously, the PWD sensor is sampled at a minimum frequency, such as 1 Hz. This raw data is then processed by a digital filter, known to those skilled in the art, to filter out background noise and help isolate the relevant data. More particularly, a low pass filter may be used to process the initial, raw pressure data. A cross-correlation algorithm is then applied to the data using a referenced signal, such as a step function or sinusoidal function, the details of which can be found in the '158 application. Finally, a peak-detect algorithm is applied to the data, and if a significant percentage of the peaks of the identified pulses exceed the pre-set threshold for a predetermined period of time or number of cycles (as described hereinabove), then stick-slip has been detected. A warning may then be sent to the surface indicating the detection of stick-slip, or torsional vibration.

In the present alternative embodiment, extra steps may be taken to remove the stick-slip noise from the data containing the downlink telemetry signals, thereby ensuring a very reliable downlink system-possibly an approximately 100 percent reliable downlink system. Thus, in addition to the steps described in the previous paragraph, the resulting data may again be filtered using a band pass filter. The band pass filter processes the data that has already been analyzed as indicating the occurrence of stick-slip, and effectively filters the stick-slip noise out of the data set analyzed, allowing the downlink telemetry system to operate properly. The details of the band pass filter are described in the '158 application, and are hereby incorporated herein by reference. The current embodiment is preferred because the algorithm can be embedded into the downhole code, thereby ensuring a virtually 100 percent reliable downlink system while drilling.

Alternatively, substitute or additional steps may include sensing and displaying the magnitude of the torsional vibration frequency and subsequently filtering out these frequencies based on the displayed results. Methods and apparatus for sensing and displaying torsional vibration frequencies are described in U.S. Pat. No. 6,065,332 to Dominick, entitled Method and Apparatus for Sensing and Displaying Torsional Vibration, which is hereby incorporated herein by reference for all purposes.

The above discussion is meant to be illustrative of the principles and various embodiments of the present invention. While the preferred embodiment of the invention and its method of use have been shown and described, modifications thereof can be made by one skilled in the art without departing from the spirit and teachings of the invention. The embodiments described herein are exemplary only, and are not limiting. Many variations and modifications of the invention and apparatus and methods disclosed herein are possible and are within the scope of the invention. Accordingly, the scope of protection is not limited by the description set out above, but is only limited by the claims which follow, that scope including all equivalents of the subject matter of the claims.

What is claimed is:

1. A method of detecting torsional vibration in a drillstring while conducting a drilling operation in a subterranean well, the method comprising:

disposing a pressure sensor on the drillstring, the drillstring having a bottom hole assembly including a drill bit;

drilling a borehole to a first depth;

locating the pressure sensor adjacent the first depth;

sampling the pressure sensor adjacent the first depth during drilling of the borehole;

obtaining a first pressure data set;

comparing a plurality of values in the first pressure data set to a pre-determined threshold value;

identifying values of the first pressure data set that exceed the pre-determined threshold value;

determining whether the data set indicates torsional vibration in the drillstring;

sending a warning signal to the surface of the well if the data set indicates torsional vibration; and changing a downlink signal frequency in response to the warning signal.

2. The method of claim 1 further comprising removing a portion of the data set that indicates torsional vibration.

3. The method of claim 1 wherein the sampling step occurs at a frequency of at least 1 Hertz.

4. The method of claim 1 wherein the comparing a plurality of values in the first pressure data set to a pre-determined threshold value occurs for a pre-determined length of time.

5. The method of claim 1 wherein the pre-determined threshold value is any one of an amplitude value, a pressure count, or a correlation unit.

6. The method of claim 1 further comprising changing at least one drilling parameter of the drilling operation in response to the warning signal.

7. The method of claim 6 wherein the at least one drilling parameter comprises at least one of a rotations per minute value of the drillstring and a weight-on-bit value.

8. The method of claim 1 further comprising:

applying a first filter to the first data set to obtain a second data set;

applying a second filter to the second data set to obtain a third data set; and cross-correlating the third data set to obtain a fourth data set.

9. The method of claim 8 wherein the first filter comprises at least one of a median filter and an FIR filter.

10. The method of claim 8 further comprising peak-detecting the fourth data set, including:

applying the pre-determined threshold value to the fourth data set;

marking peak amplitude values exceeding the pre-determined threshold value; and sending a warning signal to the surface of the well if a significant number of marked peak amplitude values occur for more than a predetermined amount of time.

11. The method of claim 10 wherein the predetermined amount of time comprises the range of five to ten cycles.

12. A method of reducing noise caused by torsional vibration in a drillstring while drilling in a subterranean well, the drillstring being part of a drilling assembly having a mud pulse telemetry system capable of sending uplink or downlink signals, the method composing:

detecting torsional vibration in the drillstring; and changing the downlink signal frequency such that the torsional vibration frequency does not interfere with the downlink signal frequency.

13. A method of detecting torsional vibration in a drillstring while drilling in a subterranean well, the drillstring being part of a drilling assembly having a mud pulse telemetry system capable of sending uplink or downlink signals, the method comprising:

sampling a downhole pressure sensor at a frequency of at least 1 Hertz to obtain a first data set;

cross-correlating the first data set using a reference signal to obtain a second data set;

peak-detecting the second data set to determine whether the second data set indicates torsional vibration in the drillstring; and sending a warning to the surface of the well if torsional vibration is indicated.

14. The method of claim 13 wherein the reference signal comprises at least one of a step function and a sinusoidal function.

15. The method of claim 13 further comprising:

calculating the torsional vibration frequency; and filtering out the torsional vibration frequency.

16. A drilling assembly for detecting torsional vibration in a drillstring located in a subterranean well, the assembly comprising:

a drillstring having a bottom hole assembly including a drill bit;

a pressure sensor disposed on the drillstring near the bottom hole assembly;

a control system disposed on the drillstring adjacent the pressure sensor and in communication with the pressure sensor; and a scheme embedded in the control system adjacent the pressure sensor, the scheme including an algorithm for comparing a plurality of sampled pressures to a pre-determined threshold value, identifying sampled pressures that exceed the pre-determined threshold value, determining whether the drillstring is experiencing torsional vibration, and transmitting an instruction to change the downlink signal frequency in response to torsional vibration.

17. The drilling assembly of claim 16 wherein the scheme further composes:

a median filter;

an FIR filter;

a cross-correlation, algorithm; and a peak-detect algorithm for applying the pre-determined threshold value to the pressure samples.

18. The drilling assembly of claim 17 further comprising a downhole transmitter for sending a warning signal to the surface of the well when a significant number of the pressure sample values exceed the pre-determined threshold value for a pre-determined amount of time.

19. The drilling assembly of claim 18 wherein the pre-determined amount of time is in the range of five to ten cycles.

20. A method of detecting torsional vibration in a drillstring while conducting a drilling operation in a subterranean well, the method comprising:

disposing a pressure sensor on the drillstring, the drillstring having a bottom hole assembly including a drill bit;

drilling a borehole to a first depth;

locating the pressure sensor adjacent the first depth;

sampling the pressure sensor adjacent the first depth during drilling of the borehole, the sampling occurring within a bore of the drillstring;

obtaining a first pressure data set;

determining whether the data set indicates torsional vibration in the drillstring; and wherein the determining occurs adjacent the first depth.

* * * * *